United States Patent [19]

Blum

[11] Patent Number: 4,553,293

[45] Date of Patent: Nov. 19, 1985

[54] REUSABLE TYING DEVICE

[75] Inventor: Ronald D. Blum, Roanoke, Va.

[73] Assignee: Tie-Tite Products, Incorporated, Roanoke, Va.

[21] Appl. No.: 538,949

[22] Filed: Oct. 4, 1983

[51] Int. Cl.[4] ..... A43B 11/00; F16G 11/00

[52] U.S. Cl. ..... 24/119; 24/117; 24/120; 24/306; 36/50

[58] Field of Search ..... 24/119, 117, 118, 120, 24/442, 306; 36/50

[56] References Cited

U.S. PATENT DOCUMENTS

| | | | |
|---|---|---|---|
| 303,549 | 8/1884 | Snyder | 24/120 |
| 500,497 | 6/1893 | Hathaway | 24/120 |
| 1,190,724 | 7/1916 | Chadwick | 24/119 |
| 1,221,656 | 4/1917 | Benson | 24/119 |
| 1,371,637 | 3/1921 | Meredith | 24/120 |
| 3,122,805 | 3/1964 | Hakim | 24/119 |
| 3,473,198 | 10/1969 | Meier | 24/120 |
| 4,308,672 | 1/1982 | Antonious | 36/50 |

FOREIGN PATENT DOCUMENTS

| | | | |
|---|---|---|---|
| 650180 | 1/1929 | France | 24/119 |
| 14569 | of 1908 | United Kingdom | 24/119 |

*Primary Examiner*—Victor N. Sakran

*Attorney, Agent, or Firm*—Lalos, Leeds, Keegan, Marsh, Bentzen & Kaye

[57] ABSTRACT

The invention disclosed relates to an improvement for tying devices which can be secured to laces particularly on shoes for holding the shoelace knot in place. The device disclosed employs a mechanism for securing a portion of the device to the shoe and enabling the device to be reused for securing a knot in place each and every time the laces are tied. In the embodiment disclosed, the invention also incorporates elastic or semi-rigid means for engaging the shoelace knot from opposed sides to impede the knot from becoming untied while simultaneously exposing the knot for view and maintaining the normal appearance of the bow.

5 Claims, 2 Drawing Figures

REUSABLE TYING DEVICE

BACKGROUND AND DISCUSSION OF THE INVENTION

A well-known problem with shoelaces, other types of laces and similar items which are tied together is that they may often become untied requiring the wearer to stop whatever activity he or she is pursuing and to retie the shoelaces to a satisfactory position. Particularly with respect to children in their play activities, this places a burden on their parents and other adults around them. In sports activities it can actually stop play altogether or require a player to be removed from a game until his laces are properly tied. In other sports loose or untied shoelaces may cause the athlete to lose his concentration and adversely affect performance.

In addition to the functional features of tying devices, shoes and socks and other footwear have recently become the basis for and subject of various ornaments. Thus, in addition to the utility of having a knot secured, it is also desirable to have the device amenable to support various art work. The form of attachment to the shoelaces should make the device relatively easy to secure to the shoe while displaying the art work in a manner acceptable to the purchasing public.

Although devices have existed previously to prevent shoelaces from becoming untied they have suffered from a number of problems which has detracted from their acceptance by the general public. Many of these problems have been overcome by an invention disclosed and claimed in U.S. application Ser. No. 497,705 and filed on May 24, 1983. The devices prior to my earlier invention were often cumbersome, extremely complicated and costly and not cosmetically pleasing to the eye. Because of the complexity and the time required to secure a device to the shoe, it was simply not worth the effort to employ complicated devices regardless of their utility. Furthermore, the device may not have been configured to remain on the shoe when the shoes were untied for storage for other nonuse.

Although disposable devices have become available, some users simply prefer to have a reusable device, because it may be more economical, more appealing to the eye and generally more acceptable in the marketplace. The invention described in my copending application entitled REUSABLE TYING DEVICES, Ser. No. 521,942, filed Aug. 10, 1983, overcomes many of the problems discussed above and are improvements upon at least to some extent the invention disclosed in my earlier application as aforementioned. The invention disclosed herein is another improvement and overcomes many of the same problems.

Generally, the device disclosed includes a tying portion which permits the device to be secured to the shoe and a body portion which extends beneath the knot when the device is secured to the shoe for exposing and displaying art work. In addition, the device disclosed includes features for holding the knot in place in an ornamental and appealing manner. The knot is exposed with minimum obstruction by a holding mechanism without detracting from the utility of securing the knot in place, or affecting the aesthetics of the bow.

The device includes body portion for supporting any art work beneath the knot and a tying member for securing the device to the shoe. The tying member includes two spaced eyelets such that the laces can extend through the eyelets and tie into a knot on the front face of the tying member. Extending between the tying member and the body portion are spaced band portions or flexible connectors for engagement with the knot. The tying member also includes one portion of a separable fastener member which cooperates with another portion of a separable fastener member on the body portion to lock the two portions together with the flexible connectors in tension for securing the knot in place. More specifically the separable fasteners are of the hook and loop type having complementary portions on body portion and tying member for interengagement with another.

The above has been a brief discussion of certain deficiencies which have existed in tying devices and features of an invention which have overcome these deficiencies. Other advantages of the invention will be apparent from the detailed description of the preferred embodiment which follows.

DETAILED DESCRIPTION OF THE PREFERRED EMBODIMENT

Figure 1:
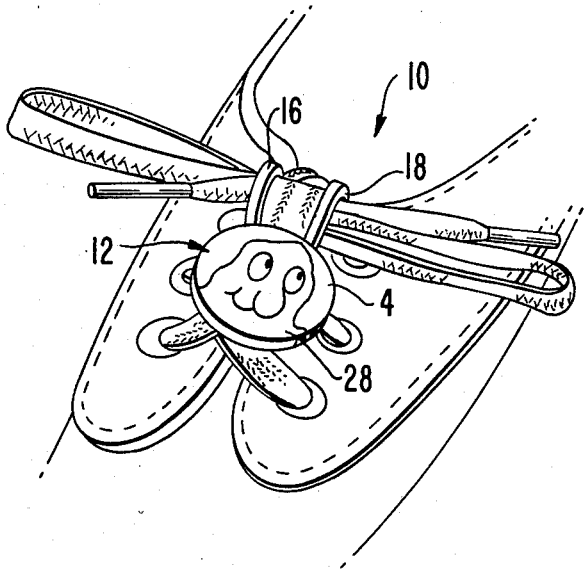
FIG. 1 is a perspective view of a preferred embodiment of the tying device of the invention when secured to a shoe.
Figure 2:
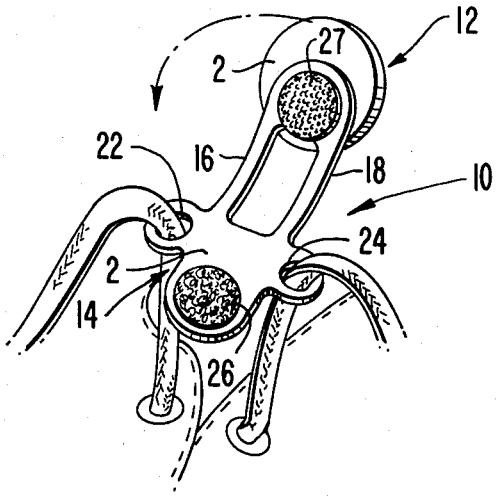
FIG. 2 is a view of the device as shown in FIG. 1 before it is secured to a shoe.

As can be seen from FIGS. 1 and 2, device 10 is generally comprised of two basic portions, a body portion 12 and a tying or eyelet member 14, the latter of which serves as a means for securing the device 10 to the shoe or other support member. The body portion 12 and tying member 14 are connected by two spaced flexible or elastic band members 16 and 18 which extend generally parallel disposition between elements 12 and 14. The band members 16 and 18 are dimensioned to permit body portion 12 to be stretched over the shoelace knot and interlock with tying member 14 to maintain the laces in a tied disposition as shown in FIG. 1. Body portion 12, tying members 14, band members 16 and 18, together define a rear face 2 and a front face 4. The front face 4 of the body portion 12 in this embodiment is generally circular in configuration and carries an art work 28 for display on the shoe when the device is fixed in place as shown. Although, in this embodiment body portion 12 is circular, other configurations may be employed as desired. In any event, the device 10 is generally planar in configuration and of unitary structure except fastener members and art work.

Tying member 14 includes two eyelets 22 and 24 spaced from one another and located on either side of band members 16 and 18 as shown for receiving the laces of a shoe in a convenient manner. A first portion 26 of a separable fastener is located between the eyelets 24 and 22 and is positioned relative to center line connecting the eyelets more remote from the body portion 12 than the eyelets 24 and 22. With this configuration fastener portion 26 extends beyond the knot when the device is secured to shoelaces of a shoe exposed for cooperation with a complementary member. A second portion 24 of a separable fastener is supported on rear face 2 of body portion 12 for registering with first portion 26. As shown in this embodiment portion 26 is the loop or pile portion and portion 24 is the hook portion of a hook and loop type fastener. When pressed together the hooks will interengage the loops and retain the body portion secured to the tying member until released by the wearer. An example of the type of fastener used is the type sold under the trademark Velcro.

In operation the device is initially secured to the shoe by lacing the two laces respectively through eyelets 22 and 24 with the rear face facing upwardly and the first portion 26 of the fastener extending beyond the laces. The shoelaces are then tied in a knot as they normally would. Once the laces are completely and satisfactorily tied, the body portion 12 is grasped and pulled or looped over the knot and secured until the fastener portions 26 and 24 are in registration. Body portion 12 is then locked to tying member 14 by pressing hook portion 24 into its pile portion 26. Because of the location of the fastener portion 24 adjacent one edge of the body portion 12, body portion 12 for the most part will extend well beyond the knot to conveniently and readily display the art work supported on front face 4 of the body portion. In addition, the elastic band members 16 and 18 are maintained in tension about the knot and grasp the knot from opposed sides to hold the knot in place. And the knot for the most part is exposed for view and has an appearance which is acceptable to the purchasing public.

What is claimed is:

1. A device for securing tied shoelaces comprising:

(a) a body portion;

(b) a securing member extending from said body portion, said member including means for securing said device to shoelaces;

(c) said body portion and said securing member being connected by spaced flexible connector members of sufficient dimensions to extend over a shoelace knot and impede the knot from untying;

(d) said connector members include two spaced elastic band members spaced to engage the knot from opposing sides while exposing the knot for view;

(e) said device including a rear face and a front face, said rear face of said securing member having first portion of a separable fastener, and said rear face of said body portion having a complementary second portion of a fastener for releasable engagement with said first portion to releasably fasten said body portion to said securing member; and (f) said fastener being of the hook and loop type.

2. The device according to claim 1 wherein said rear face of said body portion carries a loop portion and said rear face of said tying member carrying a complementary hook portion for releasable interengagement with said loop portion.

3. The device according to claim 2 wherein said means for securing said device to shoelaces includes first and second shoelace eyelets spaced from each other, said first portion of a separable fastener being spaced between said first and second shoelace eyelets.

4. The device according to claim 3 wherein said device is of a substantially planar configuration, the front face of said body portion having an artistic work affixed thereto, said front face being configured for exposing said artistic work for view when said body portion is secured to said securing member about a shoelace knot.

5. The device according to claim 4 wherein said body portion, said tying member and said spaced flexible connector members are of unitary structure made from flexible elastic material such as rubber.

* * * * *